US005957758A

United States Patent [19]

Shrum

[11] Patent Number: 5,957,758

[45] Date of Patent: Sep. 28, 1999

[54] BELT SANDER

[76] Inventor: Richard Wayne Shrum, 3268 Summerow Rd., Lincolnton, N.C. 28092-7135

[21] Appl. No.: 09/069,588

[22] Filed: Apr. 29, 1998

Related U.S. Application Data

[60] Provisional application No. 60/046,861, May 8, 1997.

[51] Int. Cl.[6] ..... B24B 21/00

[52] U.S. Cl. ..... 451/59

[58] Field of Search ..... 451/296, 311, 451/355

[56] References Cited

U.S. PATENT DOCUMENTS 2,259,941 10/1941 Primeaux ..... 451/311

3,566,549 3/1971 Britton ..... 451/355

*Primary Examiner*—David A. Scherbel

*Assistant Examiner*—Anthony Ojini

[57] ABSTRACT

A portable belt sander includes two rotatable arms, each of which is urged outward by a torsion spring. The compression resistance of the torsion spring may be increased by compressing a bladder provided within the coil of the torsion spring. The arms may be locked in their maximum outward position by spring catches and a plate secured to the arms.

4 Claims, 3 Drawing Sheets

BELT SANDER

BACKGROUND OF THE INVENTION

This application claims the benefit of U.S. Provisional Application No. 60/046,861 filed May 8, 1997.

The field of the invention is portable belt abrasive devices in which the belt is fitted over a drive wheel and two idler wheels. The drive wheel may be seated in a mounting body, while either or both of the idler wheels are mounted in an arm. One or both arms may be adjusted relative to the mounting body if a curved workpiece is to be abraded.

This invention relates to, and more particularly pertains to a new and improved portable belt sander which is adapted to sand not only a flat workpiece, but to sand a curved workpiece. While sanding a curved workpiece, the sander is self-adjustable to engage a relatively large surface of the workpiece.

Britton, U.S. Pat. No. 3,566,549, discloses a small belt sander operated by a portable power drill. A torsion spring bears against a stationary arm and a pivotable arm.

Primeaux, U.S. Pat. No. 2,259,941, discloses a surface polisher in which a spring bears against two plates, each of which pivot about a hinge.

Neither Britton nor Primeaux disclose a belt abrasive device having pivotable arms forced outwards by a spring whose force can be varied. Neither do they provide an attachment for locking the legs in a fixed position for flat surface polishing.

SUMMARY OF THE INVENTION

It is therefore an object of the present invention to provide a portable, inexpensive abrasive device which is usable on both flat and curved surfaces.

It is a further object of the invention to provide an abrasive device in which the angle between the legs is adjustable and the force exerted on the legs can be varied, thereby varying the tension on the belt.

These and other objects are provided by a portable abrasive device comprising a frame, herein called a head body, and first and second arms each pivotally mounted to said frame; a drive wheel mounted to said frame; a first idler wheel mounted to said first arm and a second idler wheel mounted to said second arm, said drive wheel and first and second idler wheels adapted to receive an abrasive belt disposed therearound; and a torsion spring mounted on said frame and bearing outward against said first and second arms. The resistance to compression of the torsion spring may be varied by adjusting the diameter of a compression bladder disposed within the coil of the torsion spring.

The inventive device allows portable abrasive work on curved objects. The arms may be locked to generate high belt tension, or they may be unlocked to generate a lower belt tension and provide greater surface coverage through utilization of the belt slack. When the arms are unlocked, turning the tension knob increases the belt tension by twenty to thirty percent in the mid to final stages of inward arm travel.

The motor may be rotated to provide the user with a comfortable throttle position, and the support handle may be placed in any of three positions.

BRIEF DESCRIPTION OF THE DRAWINGS

In order to facilitate a better understanding of the characteristics of the invention to those skilled in the art, a detailed description will be made on the basis of the accompanying drawings. Like numbers refer to like elements. The drawings are not necessarily drawn to scale.

DETAILED DESCRIPTION OF THE PREFERRED EMBODIMENT

Figure 1:
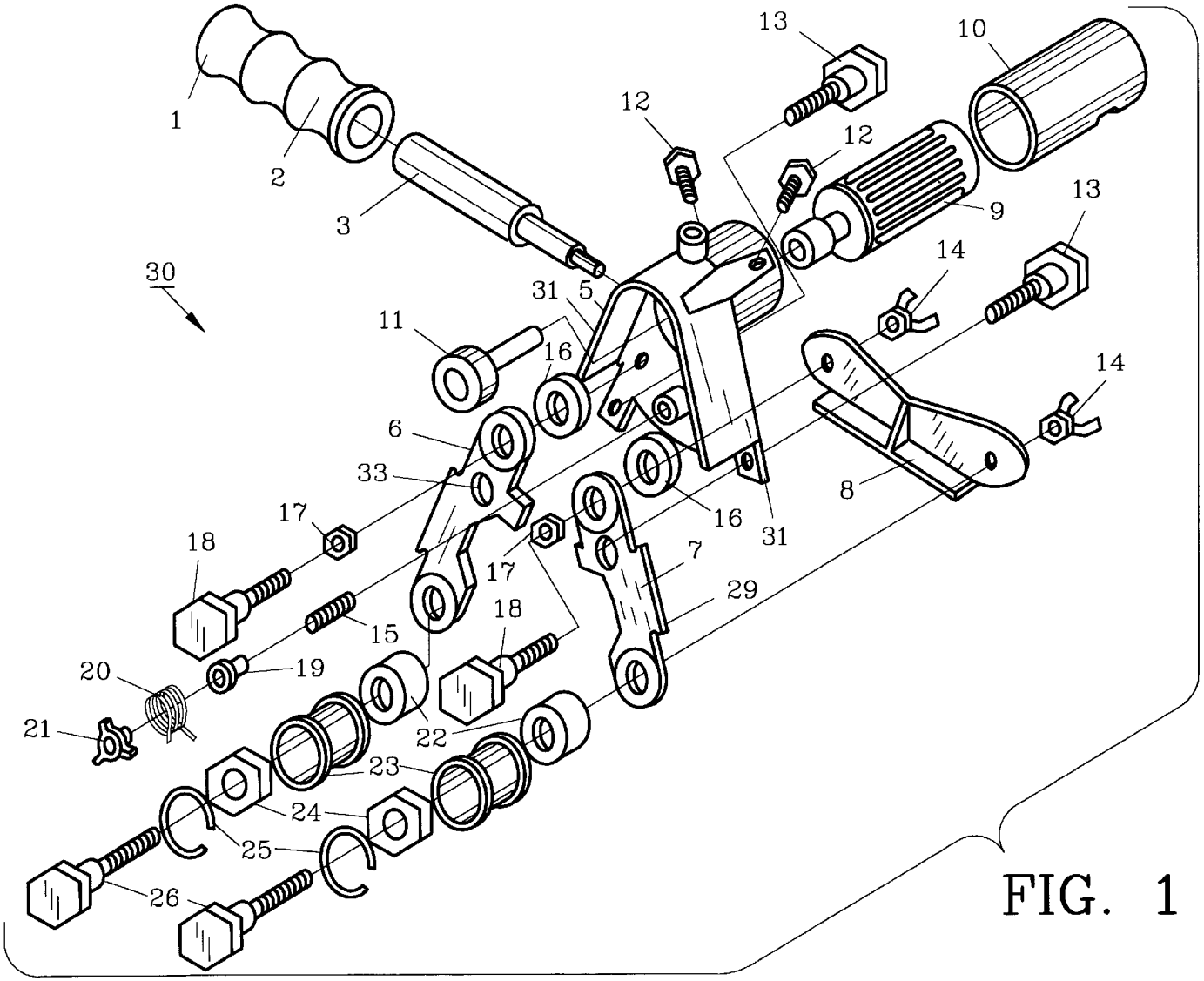
FIG. 1 shows a front elevation view of a device according to the preferred embodiment.

FIG. 1 shows a belt sander 30 according to the preferred embodiment. Belt sander 30 comprises a head body 5, a motor 9 (shown in FIG. 3); a handle 3 supplied with a hand grip 2; first and second arms 6, 7; an abrasive belt 28; and a torsion spring 20, which is secured to head body 5 and bears against each arm 6, 7 at a slotted shoulder 27.

Figure 2:
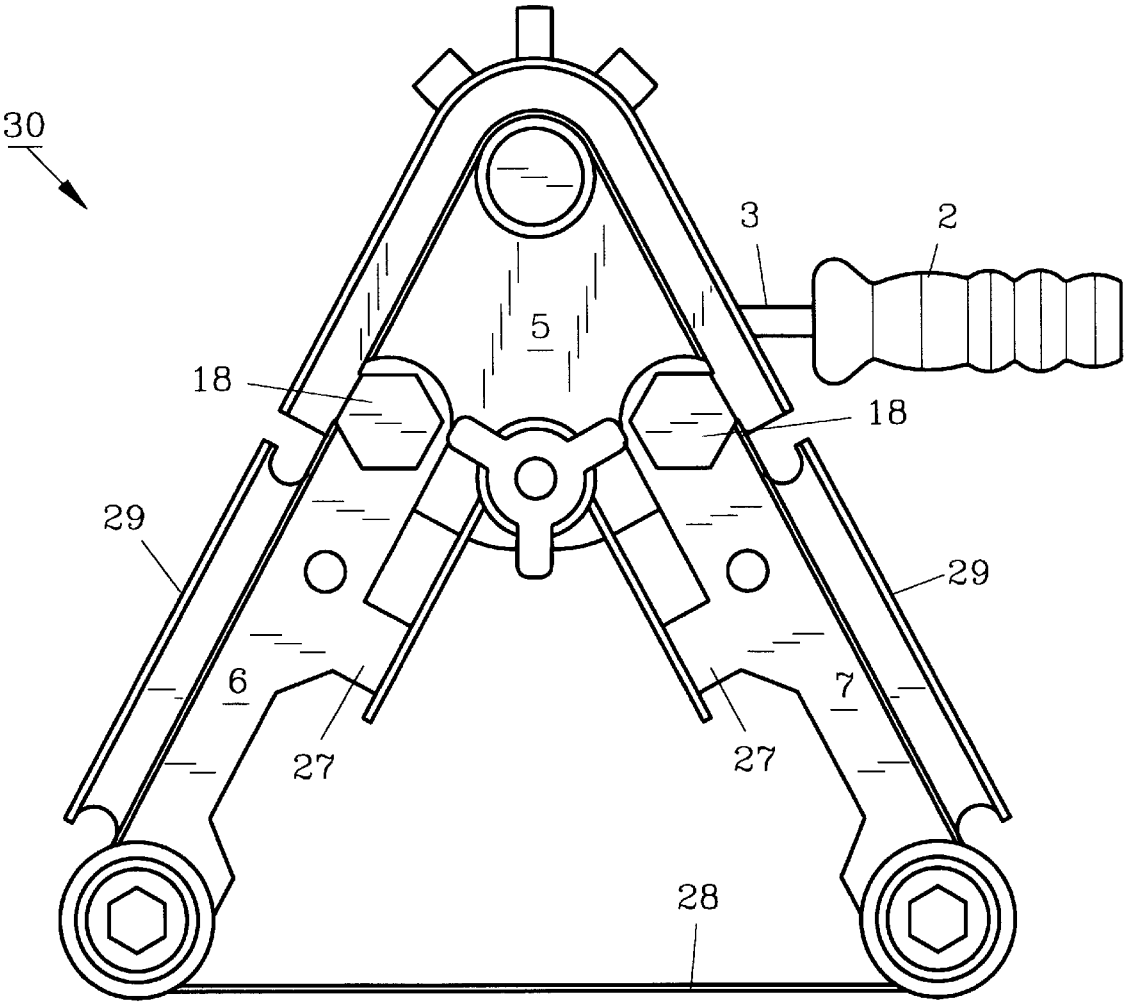
FIG. 2 shows a front elevation view of the device of FIG. 1 isolating the range of motion of the arms; and, FIG. 3 is an exploded view of the device of FIG. 1.

As shown in FIG. 2, each arm 6, 7 is free to rotate about a bolt 18 which is seated in head body 5. A torsion spring 20 also is mounted to head body 5 at a position between and slightly below bolts 18. The free ends of torsion spring 20 each is received in a slot (best seen in FIG. 3) formed in a shoulder 27 of an arm 6, 7. If pressed forcefully against the torsion spring 20, the arms 6, 7 may be brought toward each other until idler wheels 23 touch each other. However, mechanical stops could be supplied to restrain inward movement of arms 6, 7 to the position shown in FIG. 2. If unrestrained by a belt 28, arms 6, 7 move outward as indicated by the arrows shown in FIG. 2 until arm belt shields 29 come to rest against head body belt shield 31 (see FIG. 3).

A more detailed description of the belt sander of the preferred embodiment will now be made with reference to FIG. 3.

Head body 5 comprises an arc-shaped plate provided with a rearwardly extending hollow cylinder for receiving motor 9; a belt shield 31; and a pair of holes for receiving arm-securing bolts 18. Head body 5 also comprises a pair of depending tabs 32 whose function is explained below. Head body 5 is formed of a metal strong enough to bear the forces exerted during sanding operations. An instructional sticker 4 may be attached to the top outer surface of the belt shield to indicate the direction of belt rotation.

Motor 9, which drives drive wheel 11, may be any suitable conventional motor commonly sold as die grinders. One example is model number JSM-512 supplied by JET equipment and tools, located in Taiwan. The JSM-512 is a pneumatic motor and has a free speed of 22,000 RPM, and is 6 ¾ inches long. It operates from an air pressure of 90 psi. It is supplied with a one-quarter inch collet. Motor 9 is operated by squeezing the throttle, seen in FIG. 3, mounted to the outer surface thereof. Motor 9 is covered by a conventional gripping member 10.

The outer cylindrical surface of motor 9 is inserted within a bore provided in a reawardly projecting cylinder of head body 5, which bore is sized to snugly receive motor 9. After motor 9 has been inserted to a suitable length, nylon-tipped set screws 12 are tightened by a hex wrench to secure motor 9 to head body 5.

Figure 3:
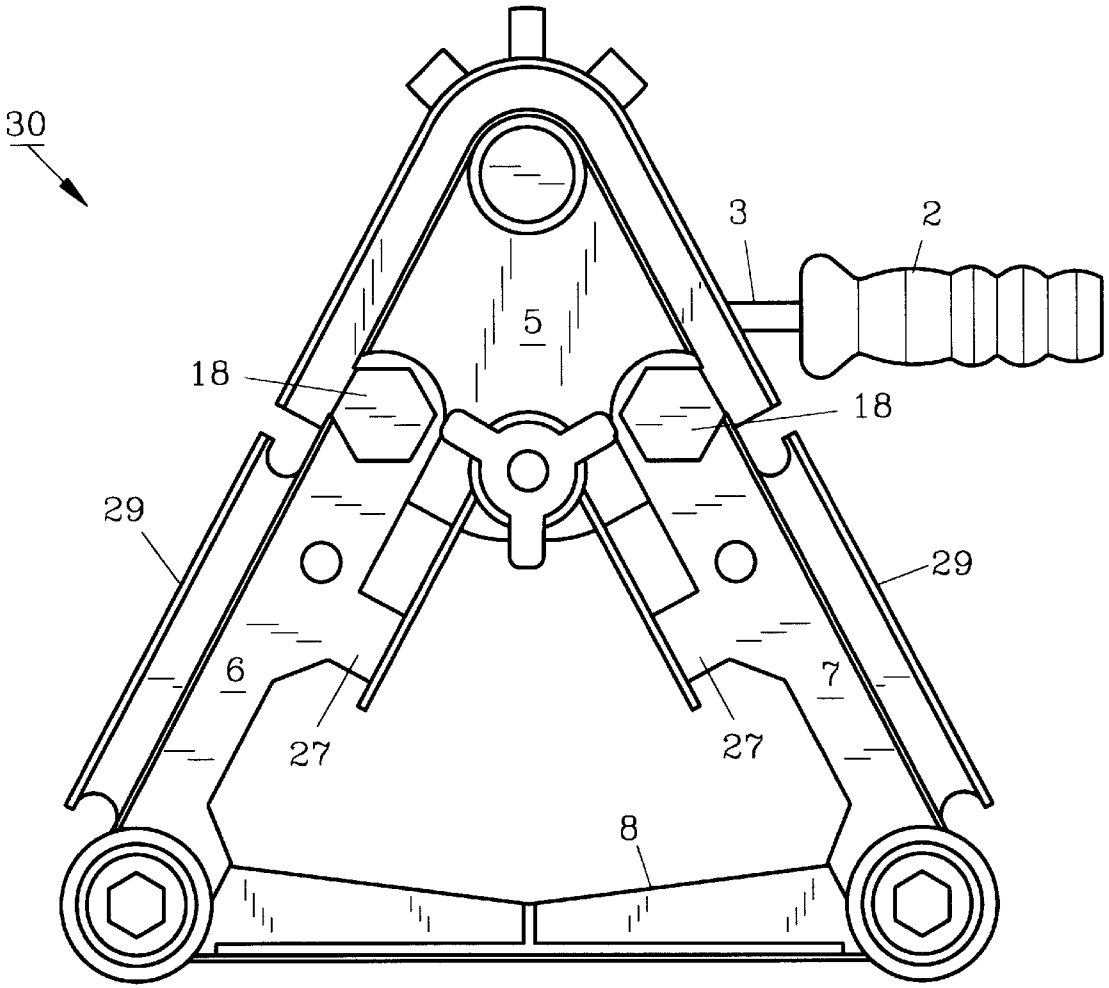

A handle 3 is provided with an externally threaded tip, which is seated either in an internally threaded mounting lug provided at the top of head body 5 or an internally threaded hole, partially shown in FIG. 3, provided in a web which downwardly projects from the rearwardly projecting cylinder of head body 5. The user places one hand about motor gripping member 10 and the other hand about handle grip 2 during operation. Handle 3 may be hollow to reduce weight, and may therefore be provided with a handle plug 1. Handle 3 may be placed either in a top, left, or right position to suit the convenience of the user.

Drive wheel 11 is provided with a shank which is received within the collet of motor 9. Drive wheel 11 is provided with a rubber coating about which belt 28 is partially wrapped.

First arm 6 and second arm 7 each comprise a plate provided with an upper hole for receiving a bolt 18 and a lower hole for receiving a wheel stud 26. First arm 6 and second arm 7 each are also provided with a hole 33. When an arm is disposed in its maximum outward position such that head body belt shield 31 impinges against arm belt shields 29, hole 33 is in registration with a hole provided in a tab 32. First arm 6 and second arm 7 also are each provided with a slotted shoulder 27 providing a bearing surface for torsion spring 20.

A thrust washer 16 is disposed between each arm upper hole and the head body 5. A bronze bushing 17 is disposed between each arm and the head of bolt 18.

To the front of each arm lower hole is assembled a wheel spacer 22, an idler wheel 23, a wheel bearing 24, a retainer ring 25, and a wheel stud 26 for securing an idler wheel 23 to an arm.

To the front of head body 5 projects a cylinder in which a tension knob stud 15 is seated. Surrounding this cylinder is compression bladder 19. Compression bladder 19 may be formed of a rubber material having a Durometer rating of 35–45. The coil of tension spring 20 is disposed about compression bladder 19. A knob 21 is screwed over knob stud 15. Knob 21 is provided with a cylindrical shoulder facing bladder 19.

If the user desires to increase the resistance of tension spring 20 against inward movement of the arms, knob 21 may be advanced, thereby compressing the compression bladder 19 between the shoulder of knob 21 and the front surface of head body 5. As the compression bladder 19 is loaded in compression, its axial compression is accompanied by lateral expansion, that is, expansion normal to the direction of the load applied by knob 21.

As the torsion spring 20 is compressed in a plane perpendicular to the axis of its coil, its internal diameter decreases. When the knob 21 is advanced, the lateral surface of compression bladder 19, which is formed of resilient material, bears against the internal surface of the coil. To compress arms 6, 7 thereafter, the force exerted by belt 28 against arms 6, 7 must overcome not only the force exerted by the spring itself, but the force necessary to compress the lateral surface of compression bladder 19. Thus, the effective resistance of spring 20 against inward movement of the arms 6, 7 can be adjusted by advancing knob 21.

Although the inventive belt sander is designed primarily for use in the abrasion or polishing of curved surfaces, it may be adapted for use on flat surface. In such a case, the user first removes plastic caps (not shown) normally provided. The free ends of wheel studs 26 then are inserted through holes provided in a slider plate 8, said holes being in registration with the arm lower holes at their maximum outward position. Wing nuts 14 then are secured to wheel studs 26.

Even without the use of slider plate 8, spring loaded catches 13 may be placed through holes in tabs 32 and through holes 33 of arms 6, 7 to secure arms 6, 7 at their maximum outward position.

To use the inventive belt sander, one begins by installing an appropriate air line connector into the air inlet of motor 9. The shank of drive wheel 11 then is inserted into the collet of pneumatic motor 9. The collet then is tightened.

The torsion spring 20 free ends are inserted into the slots in arm shoulders 27. The handle is mounted to head body 5 in the position desired. Motor 9 is inserted into the bore of head body 5 so that the drive and idler wheels are coplanar, and set screws 12 are tightened. The placement of motor grip 10 should be such that the drive and idler wheels are in alignment when the grip 10 contacts the rear surface of head body 5.

Catches 13 are unlocked by pulling them rearward and turning them 90 degrees. A sanding or polishing belt is selected and installed over the drive and idler wheels.

When the inventive sander is used with a curved workpiece, the idler arms 23 move inward responsive to pressure applied thereto by belt 28. The belt tension may be adjusted by turning knob 21 until the pressure which must be applied to the belt sander by the user is satisfactory.

The head body and arms may be cast from 713 tensalloy™ aluminum which is powder coated, and using zinc plated bolts.

As an alternative to the preferred embodiment above described, other devices may be inserted within the tension spring to retard its contraction. For instances, a set of cylinders of differing sizes could be inserted within the spring coil, so that a knob adjustment would not need to be used. However, knob adjustment is preferred.

Although the principles of the invention may be used with one fixed arm and one movable arm, the forces generated by the device having two movable arms are symmetrical, and it is believed that the preferred embodiment as described gives superior performance.

Since the invention may be embodied in several forms without departing from the spirit or essential characteristics thereof, the preceding description is intended to be illustrative and not restrictive, since the scope of the invention is defined by the claims rather than by the description preceding them.

What is claimed is:

1. A portable abrasive device comprising:

a frame;

first and second arms, said first and second arms mounted to said frame, said first and second arms independently and selectively positionable relative to said frame;

a drive wheel, said drive wheel mounted to said frame;

a first idler wheel, said first idler wheel mounted to said first arm;

a second idler wheel, said second idler wheel mounted to said second arm;

said drive wheel and said first and second idler wheels adapted to receive an abrasive belt disposed therearound;

a torsion spring, said torsion spring mounted on said frame and bearing outward against said first and second arms and resisting inward movement of said first and second arms; and a compression bladder, said compression bladder disposed within said torsion coil, whereby said compression bladder is used to increase selectively resistance of inward movement of said first and second arms by said torsion spring.

2. The portable abrasive device of claim 1 further comprising means to lock said arms, said locking means attached to said frame.

3. A portable abrasive device comprising:

a frame;

first and second arms, said first arm mounted to said frame for rotation about a first pivot and said second arm mounted to said frame for rotation about a second pivot;

a drive wheel, said drive wheel mounted to said frame;

a first spool shaped idler wheel, said first idler wheel mounted to said first arm;

a second spool shaped idler wheel, said second idler wheel mounted to said second arm, said drive wheel, said first and second idler wheels adapted to receive an abrasive belt disposed therearound;

a torsion spring, said spring mounted on said frame and bearing outward against said first and second arms and resisting inward movement of the same; and a compression bladder, said compression bladder disposed within said torsion coil, whereby said compression bladder is used to increase selectively resistance of inward movement of said first and second arms by said torsion spring.

4. The portable abrasive device of claim 3 further comprising means to lock said arms, said locking means attached to said frame.

* * * * *